US008733964B2

(12) United States Patent
Flores

(10) Patent No.: US 8,733,964 B2
(45) Date of Patent: May 27, 2014

(54) PORTABLE ELECTRIC LAMP WITH A CASING MOUNTED IN ANGULARLY MOVABLE MANNER

(71) Applicant: Zedel, Crolles (FR)

(72) Inventor: Nicolas Flores, Gieres (FR)

(73) Assignee: Zedel, Crolles (FR)

( * ) Notice: Subject to any disclaimer, the term of this patent is extended or adjusted under 35 U.S.C. 154(b) by 0 days.

(21) Appl. No.: 13/791,051

(22) Filed: Mar. 8, 2013

(65) Prior Publication Data

US 2013/0242572 A1 Sep. 19, 2013

(30) Foreign Application Priority Data

Mar. 14, 2012 (FR) ..... 12 00771

(51) Int. Cl.
*F21L 4/00* (2006.01)
*F21V 11/00* (2006.01)

(52) U.S. Cl.
USPC ..... 362/190; 362/157; 362/189; 362/191; 362/362; 362/372

(58) Field of Classification Search
None
See application file for complete search history.

(56) References Cited

U.S. PATENT DOCUMENTS

| | | | | |
|---|---|---|---|---|
| 1,352,708 | A | 9/1920 | Waegel | |
| 1,800,885 | A | 4/1931 | Day | |
| 5,410,461 | A * | 4/1995 | Petzl | 362/232 |
| 5,558,427 | A * | 9/1996 | Yang | 362/503 |
| 5,558,428 | A | 9/1996 | Lehrer et al. | |
| 6,024,471 | A * | 2/2000 | McDermott | 362/394 |
| 7,887,215 | B2 * | 2/2011 | Petzl et al. | 362/208 |
| 8,378,587 | B2 * | 2/2013 | Huguenin et al. | 315/291 |
| 2008/0205036 | A1 * | 8/2008 | Tarter et al. | 362/105 |
| 2009/0103289 | A1 * | 4/2009 | Petzl et al. | 362/157 |
| 2010/0219775 | A1 * | 9/2010 | Maglica et al. | 315/362 |
| 2010/0277894 | A1 * | 11/2010 | Kim | 362/105 |
| 2011/0031901 | A1 * | 2/2011 | Huguenin et al. | 315/307 |
| 2011/0227500 | A1 * | 9/2011 | West | 315/287 |
| 2013/0242545 | A1 * | 9/2013 | Flores et al. | 362/157 |
| 2014/0028195 | A1 * | 1/2014 | Marie et al. | 315/129 |

FOREIGN PATENT DOCUMENTS

| | | |
|---|---|---|
| EP | 1 965 129 A1 | 9/2008 |
| EP | 2 251 586 A2 | 11/2010 |

* cited by examiner

*Primary Examiner* — Natalie Walford
(74) *Attorney, Agent, or Firm* — Oliff PLC

(57) ABSTRACT

A portable electric lamp with a compact casing housing a lighting module, comprising a support on which the casing is mounted angularly movable around an axis of rotation, and at least one element having the global shape of a wire and comprising a part in the form of a collar-band surrounding the casing around the axis of rotation, said element being deformable by elasticity to secure the casing by friction against the support in a determined angular position.

5 Claims, 2 Drawing Sheets

PORTABLE ELECTRIC LAMP WITH A CASING MOUNTED IN ANGULARLY MOVABLE MANNER

BACKGROUND OF THE INVENTION

The invention relates to a portable electric lamp with a casing mounted in angularly movable manner, and in particular to a portable electric headlamp used in mountaineering.

STATE OF THE ART

At present, portable electric lamps are used having a compact casing comprising a lighting module containing for example light-emitting diodes (LED). Generally, the lamp comprises a support provided with a strap enabling the lamp to be worn on the head. Certain lamps, such as for example those described in European Patent application EP 1965129, have their casing mounted in angularly movable manner on the support, around an axis of rotation, so as to be able to direct the lighting according to the distance from the objects to be lighted. The lamps are further provided with pins to collaborate with adjusting notches provided on the casing in order to secure the lighting module in different positions. But these notch systems tend to wear with use. Furthermore, these notch systems are noisy and may be a hindrance to the user when he/she wishes to move discreetly.

Other lamps, such as for example those described in European Patent application EP 2251586, can comprise a support having two salient annular ends to respectively house the two ends of the casing. These annular ends also comprise adjusting notches to keep the casing in position. These annular ends are however bulky.

U.S. Pat. No. 1,352,708 can for example be cited which discloses an electric lamp comprising an angular support on which the lamp is solidly fixed by means of springs. The angular support is mounted on a spherical head which can be animated in rotation to move the lamp to various positions depending on the point which is required to be lit. But this lamp is bulky and sensitive to wear and tear.

OBJECT OF THE INVENTION

The object of the invention consists in remedying these shortcomings and in providing a portable electric lamp provided with robust and sufficiently compact means for adjusting the orientation of the lighting module.

According to one feature of the invention, it is proposed a portable electric lamp comprising at least one element having the global shape of a wire and comprising a part in the form of a collar-band surrounding the casing around the axis of rotation, said element being deformable by elasticity to secure the casing by friction against the support in a determined angular position.

A lamp is therefore provided having a lighting module the direction of which can be oriented by means of an element which is of small size and which is not sensitive to wear and tear. The element is further integrated in the casing so as to form a particularly compact assembly. Furthermore, the collar shape of a part of the element ensures that the casing is held efficiently against the support. Such a lamp enables the direction of the lighting module to be adjusted with a larger number of angular positions than that proposed by lamps of the prior art. In particular, the absence of adjusting notches provides rotation of the lighting module which is discreet.

The flexibility of the element makes angular movement of the casing easier. Thus, when an element undergoes a deformation, it allows rotation of the casing, and when the element tends to resume its shape, it performs securing of the casing in position with respect to the support.

The element can be a flexion spring exerting a biasing force able to hold the casing against the support by friction.

The casing can comprise a cylindrical part surrounded by the part in the form of a collar-band of each element.

Said element can be of metallic nature in particular to enhance the properties of being able to secure the casing in position and to provide a lasting flexible deformation.

The support can comprise at least one pin operating in conjunction with adjusting notches located on the casing to perform angular indexed adjustment of the casing.

Securing of the casing in position with respect to the support is thus enhanced.

BRIEF DESCRIPTION OF THE DRAWINGS

Other advantages and features will become more clearly apparent from the following description of particular embodiments of the invention given for non-restrictive example purposes only and represented in the appended drawings, in which.

DETAILED DESCRIPTION

Figure 1:
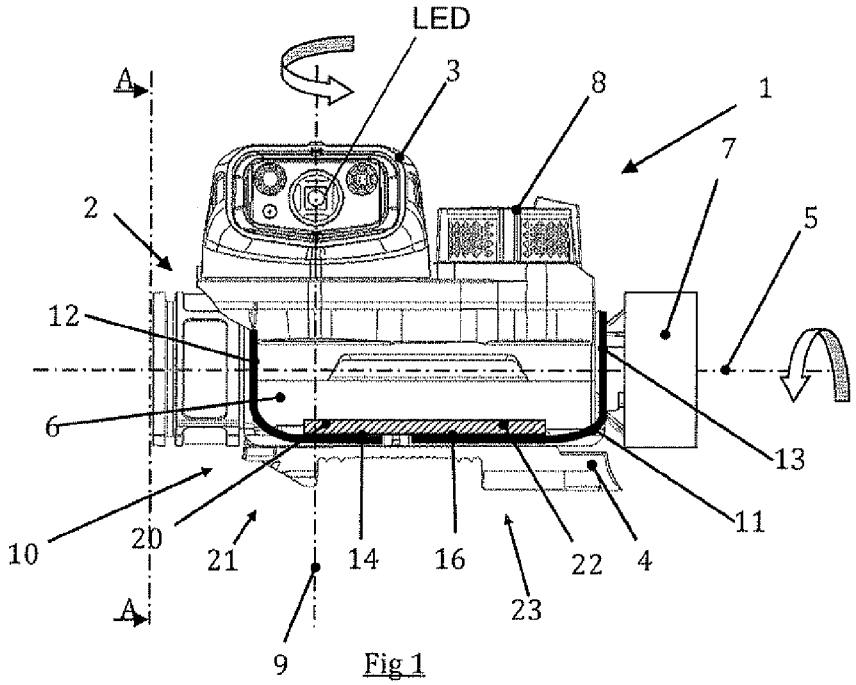
FIG. 1 schematically illustrates a perspective view of an embodiment of a portable electric lamp according to the invention.

In FIG. 1, a portable electric lamp 1 comprising a compact casing 2 housing a lighting module 3 provided with a LED, preferably a power LED, has been represented in schematic manner. Lighting module 3 can also comprise several power or standard LEDs. Casing 2 can further comprise a compartment for housing a power supply source, not represented here for simplification purposes. The power supply source is formed by a rechargeable or disposable battery and is configured to supply lighting module 3. According to another embodiment, the power supply source is housed in a compartment external to casing 2 and is coupled to lighting module 3 by means of a wired electric connection. Portable electric lamp 1 can be a headlamp or a torch lamp, and casing 2 can be made from insulating or metallic material.

Lamp 1 comprises a support 4 on which casing 2 is mounted in angularly movable manner around an axis of rotation 5 corresponding to a longitudinal axis of lamp 1. Casing 2 can be moved between a top position and a bottom position to modify the direction of lighting of the LED. In the top position, lighting of far-away objects is enhanced, and in the bottom position, that of close-up objects is enhanced. Casing 2 has a body having a cylindrical part 6 designed to be pressing against support 4 and extending along the axis of rotation 5. A control actuator 7 is provided at one end of the body of casing 2 to control lighting and extinction of lamp 1. Lamp 1 can also comprise an additional control actuator 8 situated on a top surface of the body of casing 2 in order to select activation of one LED among the LEDs of lighting module 3. Lighting module 3 can advantageously be mounted movable in rotation around a transverse axis 9 substantially perpendicular to longitudinal axis 5.

Lamp 1 further comprises at least one additional element 10, 11 to secure casing 2, and in particular cylindrical part 6, in a determined angular position with respect to support 4. In the example illustrated in FIGS. 1 and 2*a*, lamp 1 comprises two additional elements 10, 11, and it can also be envisaged to provide lamp 1 with several additional elements.

In general manner, each additional element 10, 11 has a part 12, 13 in the form of an open collar-band, in particular a C-shaped part, which surrounds cylindrical part 6 of casing 2. Each element 10, 11 comprises two ends 14 to 17 facing one another and forming opening 18, 19 of part 12, 13 in the form of a collar-band. Ends 14 to 17 are mounted fixed on support 4, for example they are respectively housed in cavities 20 to 23 provided in support 4. Each opening 18, 19 formed between two ends of an element 10, 11 enables a contact between cylindrical body 6 and support 4. In other words, part 12, 13 in the form of a collar-band extends around longitudinal axis 5 so as to allow an angular movement of cylindrical part 6 of casing 2. Advantageously, each additional element 10, 11 is achieved in flexible manner, for example made from plastic or metallic material, comprising a spring effect to tolerate a deformation on the one hand facilitating rotation of casing 2 when it is deformed and on the other hand reinforcing securing of casing 2 in position when it tends to resume to its initial shape. Casing 2 is thus held in a determined angular position, by friction of casing 2 against support 4, in order to guarantee lighting in a constant direction desired by the user. The spring effect of element 10, 11 prevents complete rotation of casing 2, i.e. rotation without any retaining. Furthermore, cylindrical part 6 of casing 2 enables several possible orientations to be obtained for lighting module 3. When assembly of additional element 10, 11 is performed, ends 14, 15 of an element 10 are housed in respective cavities 20, 21 and element 10 adopts an initial stress-free shape. Cylindrical part 6 of casing 2 is then inserted in each part 12, 13 in the form of a collar-band so that each additional element 10, 11 is deformed, in other words stressed. Stressing of ends 14, 15 presses casing 2 against support 4 to hold it in a determined angular position, in particular by the friction forces generated. Part 12, 13 in the form of a collar-band of each element 10, 11 is thus in contact with cylindrical part 6 and generates a friction force which participates with the reaction forces generated by ends 14 to 17 to efficiently secure casing 2 in a determined angular position. Additional element 10, 11 performs a hinge function enabling the orientation of lighting module 4 to be adjusted. Advantageously, each element 10, 11 is an element distinct from casing 2 and from support 4 so as to obtain elements which are simple to manufacture and to assemble.

Figure 2A:
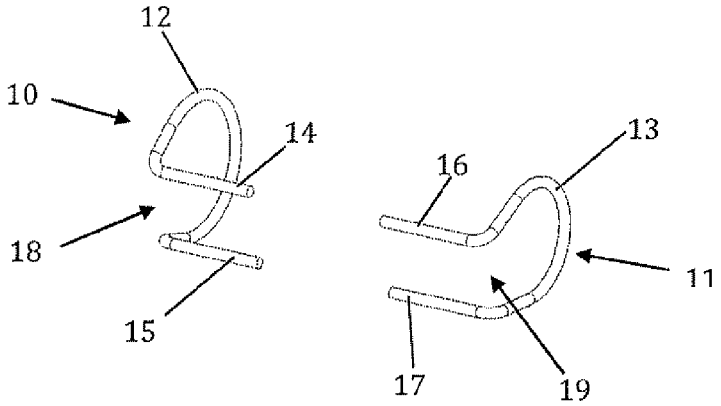
FIGS. 2*a* and 2*b* illustrate perspective views of embodiments of an element globally having the shape of a wire according to the invention.

According to an embodiment illustrated in FIG. 2*a*, lamp 1 comprises two additional elements 10, 11. Each element 10, 11 is a folded metal wire with an elastic property. In this case, each element 10, 11 comprises two ends 14 to 17 designed to be mounted fixed on support 4 and comprises a C-shaped part 12, 13 designed to be wound around cylindrical part 6 of casing 2.

Figure 2B:
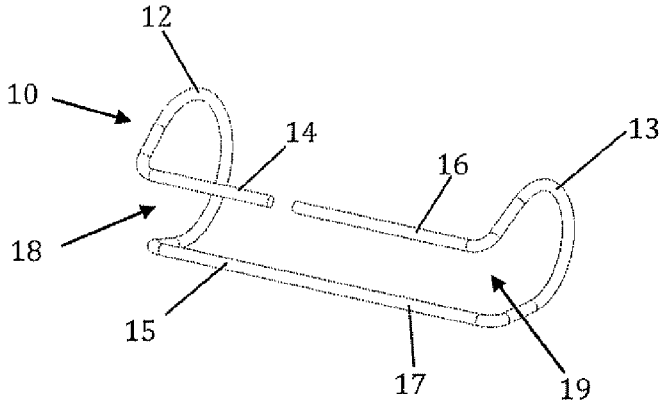

According to a preferred embodiment illustrated in FIG. 2*b*, a single additional element 10 is manufactured able to comprise one or more C-shaped parts 12, 13 surrounding casing 2. Element 10 is a folded metal wire with an elastic property to form two parts 12, 13 in the form of an open collar-band. The two parts 12, 13 of additional element 10 are joined by at least two opposite ends 14, 16 or 15, 17 so as to form a single element. The metal wire provides a better solidity to obtain a lasting spring effect.

Figure 3:
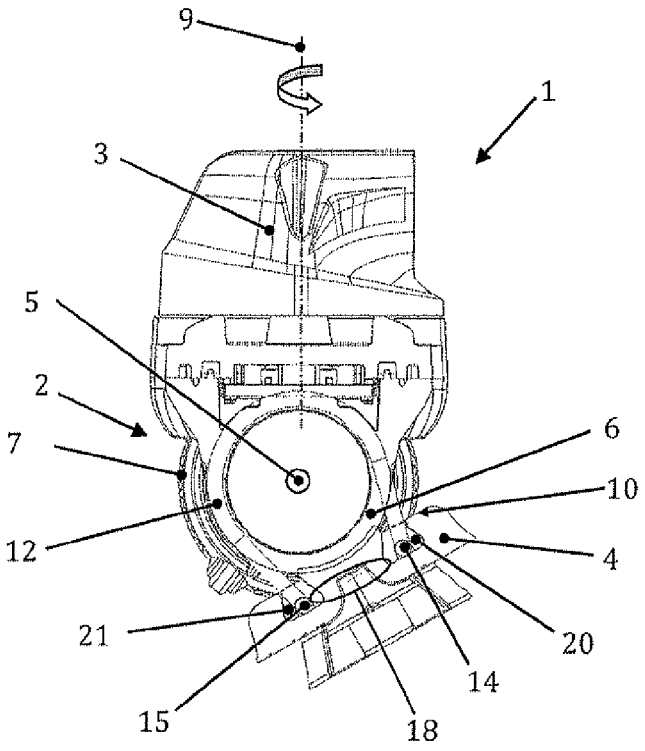
FIG. 3 schematically illustrates a cross-sectional view along the line A-A of FIG. 1.

A schematic cross-sectional view along line A-A of FIG. 1 has been represented in FIG. 3. It can be noted in FIG. 3 that support 4 is inclined by an angle of about 45° with respect to transverse axis 9.

Figure 4:
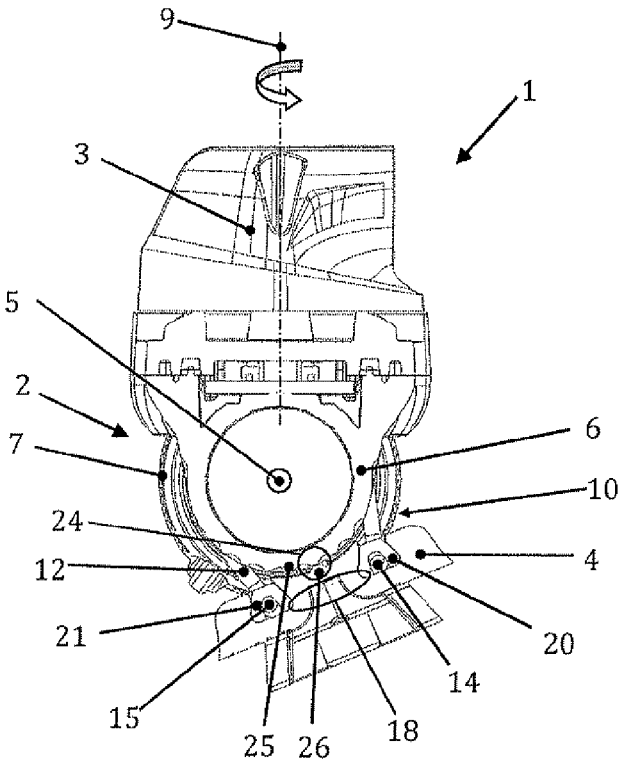
FIG. 4 schematically illustrates a cross-sectional view of another embodiment of a portable electric lamp according to the invention.

Yet another embodiment has been illustrated schematically in FIG. 4 in which lamp 1 optionally comprises an indexing system 24, for example a system 24 of adjusting notches 25, to in particular enhance securing of casing 2 in position. In this other embodiment, support 4 comprises a pin 26 designed to operate in conjunction with adjusting notches 25 mounted on casing 2. When rotation of casing 2 takes place, passing over the notches generates a force which tends to transversely displace axis of rotation 5 of lamp 1 deforming additional elements 10, 11. Transverse displacement of axis of rotation 5 is possible due to the elasticity of each element 10, 11.

A compact portable electric lamp provided with a simple and robust system is thus achieved enabling the inclination of the lighting module to be adjusted while at the same time performing securing of the latter in a position desired by the user. Rotation of the lighting module around an axis of rotation that is fixed with respect to the support can advantageously be adjusted, in particular in the direction of the longitudinal axis of the lamp, to guarantee compactness of the latter.

The invention claimed is:

1. A portable electric lamp with a compact casing housing a lighting module, comprising:

a support on which the casing is mounted angularly movable around an axis of rotation; and at least one element having the global shape of a wire and comprising a part in the form of an open collar-band surrounding the casing around the axis of rotation, the part comprising two ends mounted fixed on the support and an opening of the part formed between the two ends enables a contact between the casing and the support, and said element being deformable by elasticity to secure the casing by friction against the support in a determined angular position.

2. The portable electric lamp according to claim 1, wherein said element is a flexion spring exerting a biasing force designed to hold the casing against the support by friction.

3. The portable electric lamp according to claim 1, wherein the casing comprises a cylindrical part surrounded by the part in the form of a collar-band of each element.

4. The portable electric lamp according to claim 1, wherein said element is of metallic nature.

5. The portable electric lamp according to claim 1, wherein the support comprises at least one pin operating in conjunction with adjusting notches mounted on the casing to perform angular indexed adjustment of the casing.

* * * * *